US007958633B2

(12) United States Patent
Kenitz

(10) Patent No.: US 7,958,633 B2
(45) Date of Patent: Jun. 14, 2011

(54) ENGINE BLOCK CASTING AND METHOD OF MANUFACTURE

(75) Inventor: Roger C. Kenitz, Indianapolis, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 483 days.

(21) Appl. No.: 10/895,659

(22) Filed: Jul. 21, 2004

(65) Prior Publication Data

US 2006/0016573 A1 Jan. 26, 2006

(51) Int. Cl.
*B21K 3/00* (2006.01)
*F02B 75/18* (2006.01)

(52) U.S. Cl. ..... 29/888.01; 29/888.06; 123/41.74

(58) Field of Classification Search ..... 29/888.01, 29/527.5, 888.06; 164/11, 321, 137; 123/41.74, 123/193.3

See application file for complete search history.

(56) References Cited

U.S. PATENT DOCUMENTS

| | | | | | |
|---|---|---|---|---|---|
| 2,387,114 | A | * | 10/1945 | Bonbright et al. | 123/80 DA |
| 2,738,782 | A | * | 3/1956 | Bodine, Jr. | 123/660 |
| 3,081,755 | A | * | 3/1963 | Kotlin et al. | 123/41.77 |
| 3,168,081 | A | * | 2/1965 | Bauer | 123/41.74 |
| 3,251,279 | A | * | 5/1966 | O'Brien | 92/144 |
| 4,712,517 | A | * | 12/1987 | Anno et al. | 123/41.74 |
| 4,757,790 | A | | 7/1988 | Ushio et al. | |
| 4,757,857 | A | * | 7/1988 | Henkel | 164/137 |
| 4,856,462 | A | * | 8/1989 | Ushio et al. | 123/41.84 |
| 4,942,917 | A | | 7/1990 | Koch et al. | |
| 5,041,340 | A | * | 8/1991 | Ushio et al. | 428/614 |
| 5,115,771 | A | * | 5/1992 | Ozawa | 123/41.72 |
| 5,320,158 | A | * | 6/1994 | Helgesen | 164/76.1 |
| 5,357,921 | A | * | 10/1994 | Katoh et al. | 123/193.2 |
| 5,361,823 | A | * | 11/1994 | Kuhn et al. | 164/9 |
| 5,365,997 | A | * | 11/1994 | Helgesen et al. | 164/103 |
| 5,445,210 | A | * | 8/1995 | Brassell | 164/369 |
| 5,746,161 | A | * | 5/1998 | Boggs | 123/41.72 |
| 5,771,955 | A | * | 6/1998 | Helgesen et al. | 164/9 |
| 5,809,946 | A | * | 9/1998 | Abe | 123/41.74 |
| 6,519,848 | B2 | * | 2/2003 | Komazaki et al. | 29/888.061 |
| 6,527,039 | B2 | * | 3/2003 | Shade | 164/137 |
| 6,899,064 | B2 | * | 5/2005 | Hughes et al. | 123/41.74 |
| 6,923,363 | B2 | * | 8/2005 | Masuda | 228/122.1 |
| 6,988,480 | B2 | * | 1/2006 | Hughes et al. | 123/195 R |
| 7,392,771 | B2 | * | 7/2008 | Sunada et al. | 123/41.74 |
| 2005/0217614 | A1 | * | 10/2005 | Matsutani et al. | 123/41.74 |

FOREIGN PATENT DOCUMENTS

| | | | |
|---|---|---|---|
| DE | 10146850 | A1 | 1/2003 |
| JP | 05039748 | A | 2/1993 |
| JP | 10339206 | A | 12/1998 |
| JP | 2005201085 | A | 7/2005 |

* cited by examiner

*Primary Examiner* — Essama Omgba
(74) *Attorney, Agent, or Firm* — Jack D. Nimz; Jeffrey P. Calfa

(57) ABSTRACT

A block casting for an internal combustion engine and method of its manufacture provide reduced engine block size and weight, and/or increased engine displacement, through cylinder-forming walls that decrease in thickness from minimal explosion-resistant thicknesses at their combustion chamber ends to reduced thicknesses at their other ends.

3 Claims, 2 Drawing Sheets

ENGINE BLOCK CASTING AND METHOD OF MANUFACTURE

FIELD OF THE INVENTION

This invention relates to engine block castings for internal combustion engines, and more particularly to engine block castings of reduced weight and size, and methods of their manufacture.

BACKGROUND OF THE INVENTION

Size and weight are important considerations in internal combustion engines. It is desirable to minimize the size and weight of an internal combustion engine of a given power output; conversely, it is desirable to maximize the power output for an internal combustion engine of a given size and weight. One way to increase the power output of an internal combustion engine is to increase the displacement and/or compression ratio of the engine, which generally will lead to an engine of increased size and weight. Internal combustion engines of minimal size and weight for a given horsepower are desirable, however, because decreased engine weight for a given power output means a more efficient use of engine fuel and/or increased vehicle acceleration capacity.

Today's high-power, high-compression engines require thick cylinder walls. However, this requirement is contrary to the desire to make engines more compact. The provision of heavy thick walls in block castings all the way down the cylinder from the combustion chamber end to the lower end increases the size and weight of the block casting. In an effort to reduce engine size, cylinder walls have been cast in Siamese form, that is, shared between cylinders, but this can impede the effective use of coolant to cool the engine. Thus, there is a need for engine block castings that can reduce the size and weight of an internal combustion engine and/or increase its power generating capability in a given size.

BRIEF DESCRIPTION OF THE INVENTION

The invention provides a block casting for an internal combustion engine and a method of its manufacture that can reduce the size and weight of an internal combustion engine of a given power output that is made with the engine block casting and that can increase the ability to remove the heat of combustion from the internal combustion engine. The invention may also be incorporated into engine block castings that provide an increased engine displacement with castings of the same weight and size.

As well known in the art, engine block castings for multi-cylinder internal combustion engines include a plurality of cylindrical cavities formed by a plurality of cylindrical cavity-forming walls and adapted for the formation of piston-accepting internal combustion engine cylinders with combustion chamber portions at one of their ends. The invention provides an improvement in such engine block castings, wherein the cylindrical cavity-forming walls of such castings have thicknesses that decrease from the combustion chamber portions where the cylindrical cavity-forming walls are the thickest. Thus, in a casting for an internal combustion engine cylinder block, the means comprising walls forming a plurality of adjacent cylindrical cavities that are adapted for the formation of the cylinders of the internal combustion engine have thicknesses that taper from thicker portions adjacent their combustion chamber ends to thinner portions adjacent their other ends, and such wall means of the invention can permit the formation of coolant passages adjacent each of the cylindrical cavities, formed in part by the thinner wall portions of the wall means.

In one preferred form, the invention provides a casting for a more compact and light-weight engine block. Such a block casting includes a plurality of cylindrical cavities adapted for the formation of the cylinders of an internal combustion engine, which are formed by a plurality of integral cylinder-forming walls having combustion chamber portions at their one ends. In accordance with one aspect of the invention, the plurality of integral cylinder-forming walls include shared portions of minimal explosion-resistant thicknesses at their combustion chamber ends, and the integral cylinder-forming walls taper in thicknesses from the minimal explosion-resistant thicknesses of their combustion chamber ends to lesser thicknesses at their other ends, and the lesser thicknesses at their other ends form chambers around each of the cylindrical cavities for the circulation of an engine coolant, thereby providing a block casting of reduced size and weight and increased heat transfer capability.

The invention further provides a method of manufacturing a lighter internal combustion engine by preparing a mold for casting the outside walls of the internal combustion engine block having an inlet for the admission of molten metal into the mold, preparing one or more cylinder cores for insertion in the mold for defining casting walls forming a plurality of cylindrical cavities in the internal combustion engine block, with each cylinder core having one or more substantially right circular cylindrical walls for defining the interior walls of the cylinders in the internal combustion engine, and preparing one or more coolant jacket cores for insertion in the mold for forming a coolant path within the block adjacent the interior walls of the cylinders, said one or more coolant jacket cores having a plurality of cylindrical portions formed to surround, in a spaced relationship, the substantially right circular walls of the one or more cylinder cores that define the interior walls of the plurality of cylinders of the internal combustion engine block, with the plurality of cylindrical portions of the one or more coolant jacket cores having cross-sections that are thicker adjacent their bottoms than adjacent their tops, so that, upon assembly of the one or more cylinder cores and one or more coolant jacket cores within the mold, the walls of the one or more cylinder cores and of the one or more coolant jacket cores define casting walls forming a plurality of cylindrical cavities for the cylinders of the internal combustion engine block that are thicker at their tops than at their bottoms, reducing the weight of the block for a given internal combustion engine displacement of an internal combustion engine and permitting an increased rate of heat transfer from the cylinders of the internal combustion engine.

Other features and advantages of the invention will be apparent from the drawings and more detailed description of the invention that follow.

DETAILED DESCRIPTION OF THE PREFERRED MODE OF THE INVENTION

Figure 1:
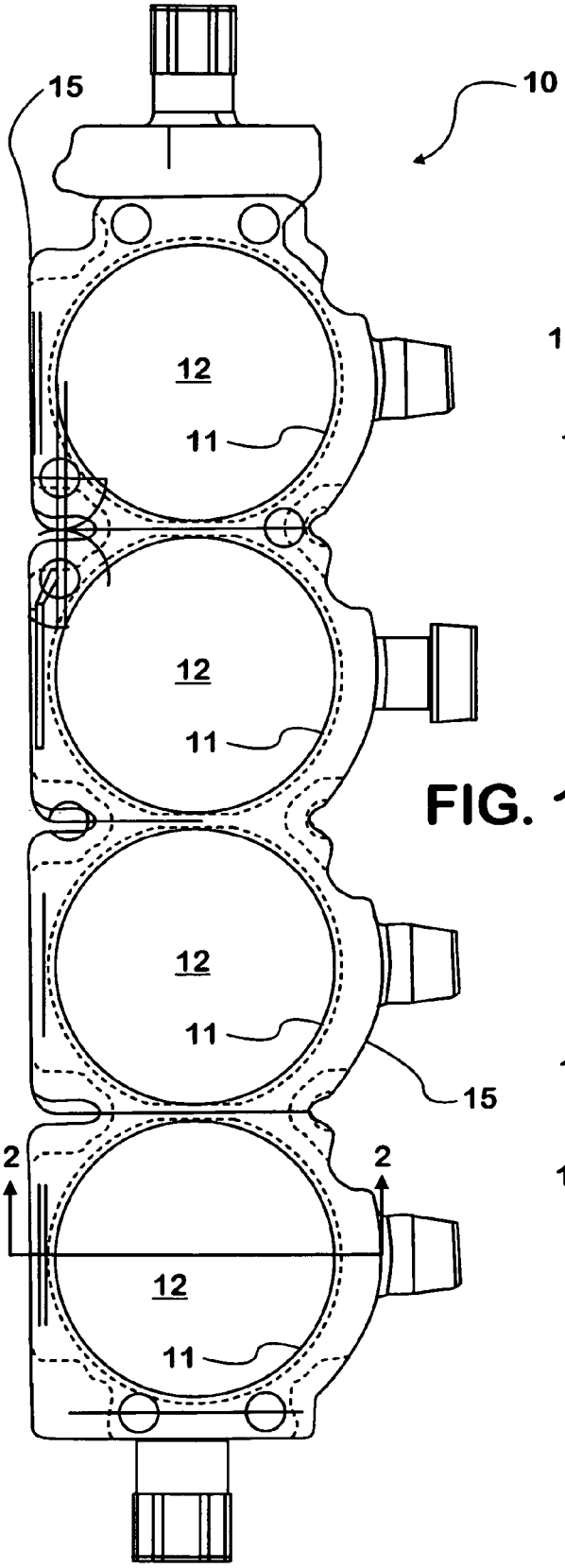
FIG. 1 is a view from above an engine block of the invention.
Figure 2:
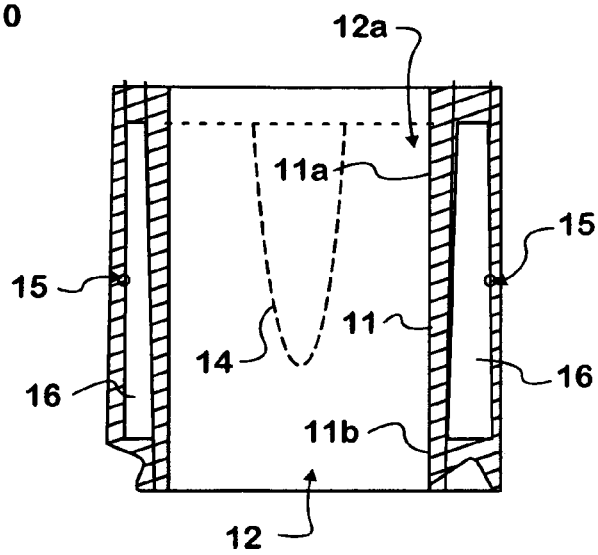
FIG. 2 is a cross-section of the engine block of FIG. 1, taken at a plane corresponding to line 2-2 of FIG. 1.

FIG. 1 and FIG. 2 illustrate one preferred engine block for an internal combustion engine which incorporates the invention. The preferred embodiment illustrated in FIGS. 1 and 2 comprises a casting 10 for a more compact and light-weight engine block. As illustrated in FIG. 1, such an engine block casting 10 is formed by means comprising walls 11 forming a plurality of adjacent cylindrical cavities 12 that are adapted for the formation of the cylinders of an internal combustion engine, with combustion chambers 12*a* at their one ends. FIG. 2 is a cross-section taken at a plane corresponding to line 2-2 through one of the plurality of cylindrical cavities formed in the engine block casting 10, with the details of the outer walls 15 of the casting 10 omitted. The cross-sectional view of FIG. 2 is typical of the cross-sections of the walls forming each of the plurality of cylindrical cavities 12. As illustrated in FIG. 2, the walls 11 have thicknesses that taper from thicker portions 11*a* adjacent their combustion (ignition) chamber ends 12*a* to thinner portions 11*b* adjacent their other ends. Thus, in the invention an engine block casting 10 for a multi-cylinder internal combustion engine includes a plurality of cylindrical cavities 12 formed by a plurality of cylindrical cavity-forming walls 11, with the invention providing an improvement wherein the plurality of cylindrical cavity-forming walls 11 have thicknesses that decrease, preferably uniformly, from the combustion chamber portions 12*a*, which are the thickest, to their other ends. In a preferred embodiment 10, which is a compact, light-weight engine block casting, the walls 11 have minimally thick explosion-resistant wall portions 11*a*, for example, about 6.5 millimeters, that are shared by adjacent cylindrical cavities 12 at their combustion chamber ends 12*a*, as illustrated in FIG. 2, in which the dotted line 14 depicts the shared wall portions of the walls 11 between adjacent cylindrical cavities 12. As further illustrated by FIG. 2, the means comprising walls 11 forming a plurality of cylindrical cavities 12 further define, within the outside walls 15 of the casting 10, an internal closed coolant passageway 16 adjacent and preferably substantially surrounding the walls 11 forming the plurality of cylindrical cavities 12. As will be apparent to those skilled in the art, the thinner walls formed at the ends 11*b* of the cylindrical cavities 12 more remote from the combustion chamber portions 12*a* of the cylindrical cavities enhance the ability of the casting to transfer heat from within the cylindrical cavities 12 to coolant flowing in the coolant passageway 16.

Figure 3:
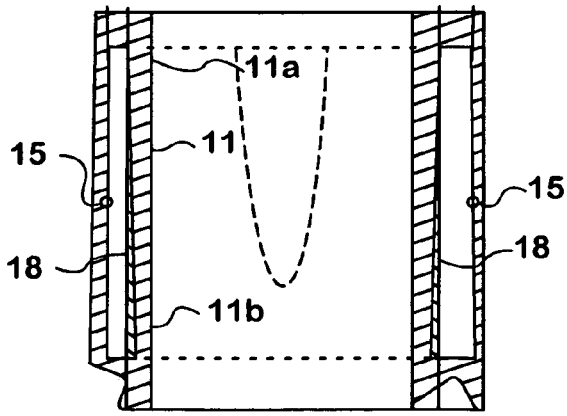
FIG. 3 is a diagrammatic view of the cross-section of FIG. 2 to illustrate the metal reduction resulting from the invention.

FIG. 3 is a cross-section corresponding to FIG. 2, illustrating by the cross-hatched area 18 the metal saved by the tapered thicknesses of the walls 11 that form the plurality of cylindrical cavities 12 in the engine block. In the embodiment illustrated in FIGS. 1-3, the thickness of the cylindrical cavity-forming walls 11 taper, reducing their thickness by about 6% from the combustion chamber ends 11*a* to their other ends 11*b*.

Thus, a preferred casting for a more compact and light-weight engine block can comprise a block casting 10, including a plurality of cylindrical cavities 12, adapted for the formation of the cylinders of an internal combustion engine, which are formed by a plurality of integral cylinder-forming walls 11, having combustion chamber portions 11*a* at their one ends, with minimal thicknesses necessary to withstand the stresses imposed on the walls 11*a* by the repetitive explosions of engine fuel within the cylindrical cavities 12. As illustrated by the dotted line 14 in FIG. 2, the plurality of integral cylinder-forming walls 11 can include portions shared between adjacent cylindrical cavities 12 to reduce the size and weight of the engine block casting, and the size and weight of the engine block casting is further reduced by the integral cylinder-forming walls 11 having a tapered thickness from the minimal explosion-resistant thicknesses of the combustion chamber ends 11*a* to lesser thicknesses at their other ends 11*b*, as further illustrated by FIG. 2. The invention permits in such a casting, for example, the weight of an engine block of a 6.4 liter, V-8 diesel engine to be reduced by about ten pounds. The invention can also permit an increase in engine displacement, for example, from 6.0 liters to 6.4 liters, in the same size engine block.

Figure 4:
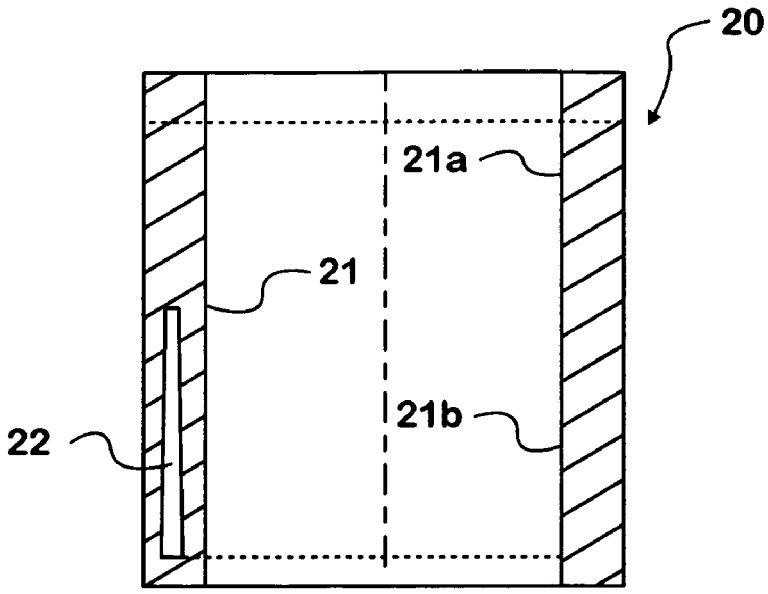
FIG. 4 is a cross-sectional view of another cylinder-forming wall to illustrate another embodiment of the invention.
Figure 5:
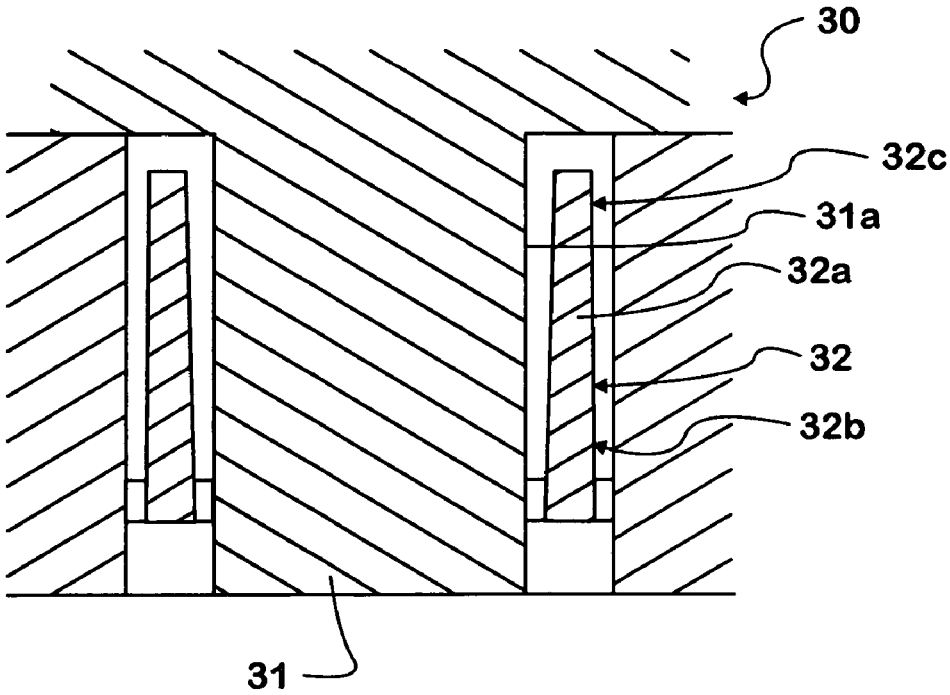
FIG. 5 is a cross-sectional view of a portion of a casting mold assembly used in a casting method of the invention.

FIG. 4 is a cross-sectional view of a cylinder-forming wall portion of another engine block casting of the invention. In the embodiment 20 of FIG. 4, the cylinder-forming walls 21 have wall thicknesses that are thicker at their combustion chamber ends 21*a* and can provide the minimal thickness necessary to withstand the many fuel-explosions of engine operation, and are thinner at their opposite ends as a result of chambers 22 for coolant flow adjacent the cylinder-forming walls 21.

The invention also includes a method of manufacturing a lighter internal combustion engine block comprising, as known in the art, preparing a mold 30 for casting the outside walls of an internal combustion engine block, having an inlet (not shown) for the admission of molten metal into the mold, and preparing one or more cylinder cores 31 for insertion in the mold for defining casting walls forming a plurality of cylindrical cavities for the cylinders of the internal combustion engine block, with each cylinder core 31 having one or more substantially right circular cylindrical walls 31*a* for defining the interior walls of the cylindrical cavities of the internal combustion engine block. In the invention, one or more coolant jacket cores 32 are prepared for insertion in the mold 30 for forming a coolant path within the block adjacent the interior walls of the cylindrical cavities that are formed by the cylindrical walls 31*a* of the cylinder cores 31, and each of the one or more coolant jacket cores 32 have a plurality of cylindrical portions 32*a* formed to surround, in a spaced relationship, the substantially right circular walls 31*a* of the one or more cylinder cores 31 that define the interior walls of the plurality of cylindrical cavities of the internal combustion engine block, and the plurality of cylindrical portions 32*a* of the one or more coolant jacket cores 32 have cross-sections that are thicker adjacent their bottoms 32*b* than adjacent their tops 32*c*. Upon assembly of the one or more cylinder cores 31 and one or more coolant jacket cores 32 within the mold 30, the walls of the one or more cylinder cores 31 and of the one of more coolant jacket cores 32 define casting walls forming a plurality of cylindrical cavities for the cylinders of the internal combustion engine block that are thicker at their tops than at their bottoms, thus reducing the rate of the weight of the block for a given internal combustion engine displacement, and permitting an increased rate of heat transfer from the cylinders of the internal combustion engine.

In the preferred compact, light-weight engine block illustrated in FIGS. 1 and 2, the cylinder walls 11 are Siamesed, that is, shared between adjacent cylinders over a portion of the length, but not the entire length, of cylindrical cavities, and the cylinder walls in the compression areas 12*a* of the cylinders have minimal explosion-resistant thicknesses to withstand the repetitive stresses imposed by the repeated explosions of fuel within the cylinders, but are tapered in their thicknesses down to thinner walls 11*b* at the other ends of the cylinders to reduce weight and allow for better flow of coolant and an increased ability to transfer heat from the cylinder-forming walls 11 to the coolant. Thus, the invention allows explosion-resistant thicker cylinder walls at the ignition chamber portions of engine cylinders that taper down to reduced wall thicknesses at the other ends of the cylinders, which reduce the engine weight and allow increased transfer of engine heat to a coolant. In one exemplary use of the invention, the displacement of a 6.0 liter V-8 diesel engine can be increased to 6.4 liters for the same size engine block while the casting weight of the engine block can be reduced by 10 pounds, and the manufacturability of the water jacket cores can be substantially improved. It is further believed that tapering the cylinder-forming walls may even add some structural strength to cast crank cases, and may help to distribute loads imposed on the casting walls without distortion. Thus, the invention permits reduced engine weight and can allow greater coolant passage flow between the cylinders and can add sand mass to the sand water jacket cores, making the cores more manufacturable.

While a preferred engine block casting and casting method have been described above, those skilled in the art will recognize that other casting blocks and methods may be devised using the invention within the scope of the following claims.

It is therefore intended that the foregoing detailed description be regarded as illustrative rather than limiting, and that it be understood that it is the following claims, including all equivalents, that are intended to define the spirit and scope of this invention.

What is claimed:

1. A casting for an internal combustion engine cylinder block comprising a succession of multiple cylindrical walls defining multiple cylinder cavities, respective walls of an immediately adjacent pair of walls having thicknesses of narrowing taper along their axial lengths in a direction from one lengthwise end of each wall of the pair toward an opposite lengthwise end, and wherein proximate the one lengthwise end of each wall of the pair, the pair join each other along confronting portions of their respective circumferences with a circumferential extent that progressively diminishes along said direction due to the narrowing taper of their thicknesses.

2. A casting as set forth in claim 1 wherein the joining of the pair diminishes to zero at a location along said direction before reaching the opposite lengthwise ends of the pair.

3. A casting as set forth in claim 2 including a water jacket bounding at least portions of the circumference of each wall of the pair, and wherein a portion of the water jacket is disposed toward the opposite lengthwise ends of the pair to bound at least a portion of the circumference of the pair beyond the location at which the joining of the pair diminishes to zero.

* * * * *